United States Patent [19]

Donaldson

[11] Patent Number: 4,770,401

[45] Date of Patent: Sep. 13, 1988

[54] POWERED C-CLAMP APPARATUS

[76] Inventor: Humel J. Donaldson, P.O. Box 101, Englewood, Kans. 67840

[21] Appl. No.: 904,490

[22] Filed: Sep. 8, 1986

[51] Int. Cl.[4] ..... B25B 1/10

[52] U.S. Cl. ..... 269/249; 269/225; 269/243; 269/279; 269/246; 269/283

[58] Field of Search ..... 269/249, 3, 225, 240, 269/243, 246, 279, 280, 283; 192/99.5

[56] References Cited

U.S. PATENT DOCUMENTS

| | | | |
|---|---|---|---|
| 1,157,001 | 10/1915 | Howard | 192/99 S |
| 4,436,294 | 3/1984 | Irelan | 269/249 |
| 4,565,358 | 1/1986 | Hosoi et al. | 269/73 |

*Primary Examiner*—Frederick R. Schmidt
*Assistant Examiner*—Judy J. Hartman
*Attorney, Agent, or Firm*—Phillip A. Rein

[57] ABSTRACT

This invention is a power C-clamp apparatus having a main housing assembly; a power drive assembly mounted within the main housing assembly; a gear drive assembly movable by the power drive assembly; a C-clamp assembly having a movable clamp member axially movable by the gear drive assembly; and a power control assembly operable to selectively control and energize the power drive assembly. The power drive assembly includes a main motor assembly operable through an adjustable clutch assembly to drive the gear drive assembly. The gear drive assembly includes a drive gear member engageable with a driven gear member to selectively move the movable clamp member. The C-clamp assembly includes the movable clamp member and a plurality of interchangable clamp members to cooperate with the movable clamp member. The power control assembly includes a circuit assembly having a control switch therein to drive the main motor assembly in reversible directions and a limit switch to automatically provide a control and safety feature for stopping the movable clamp member at its outer limits of movement.

13 Claims, 2 Drawing Sheets

FIG. 1
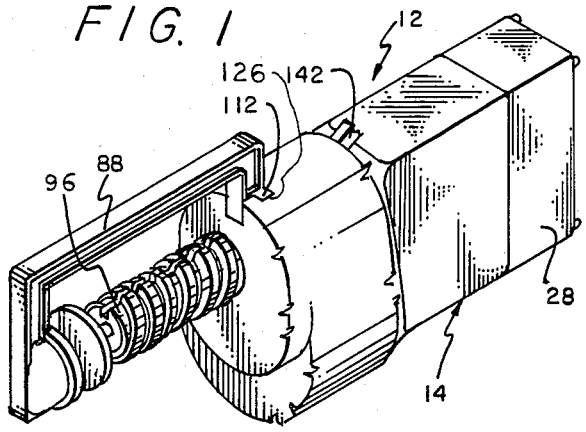
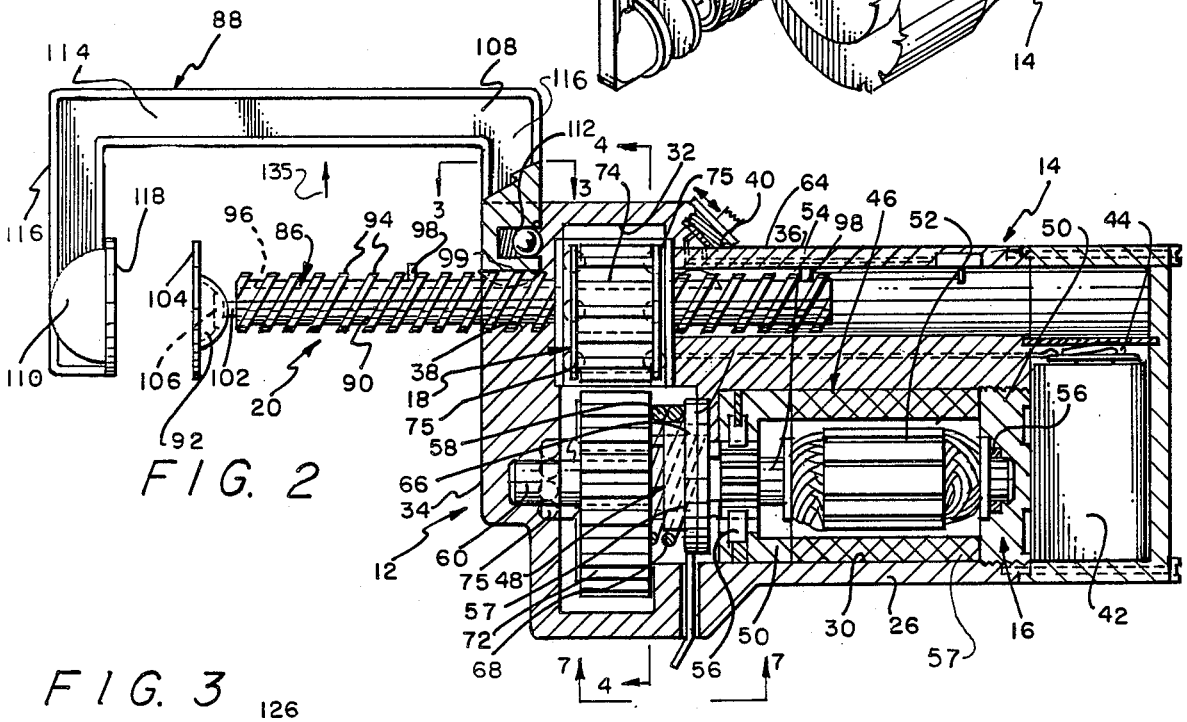
FIG. 2
FIG. 3
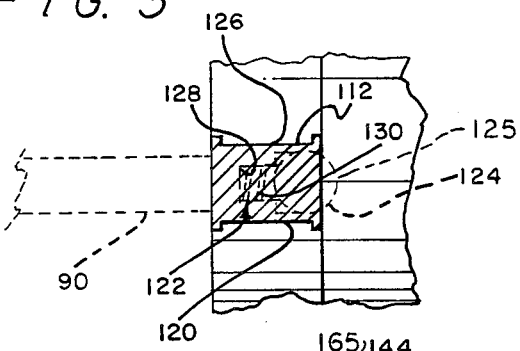
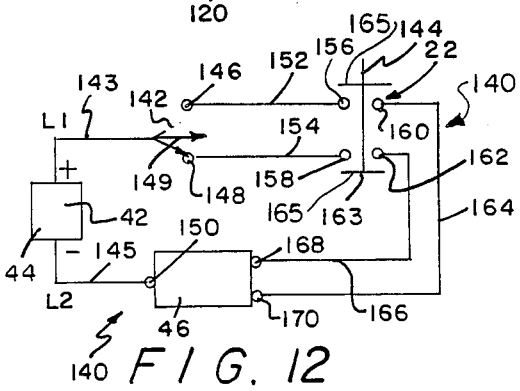
FIG. 12
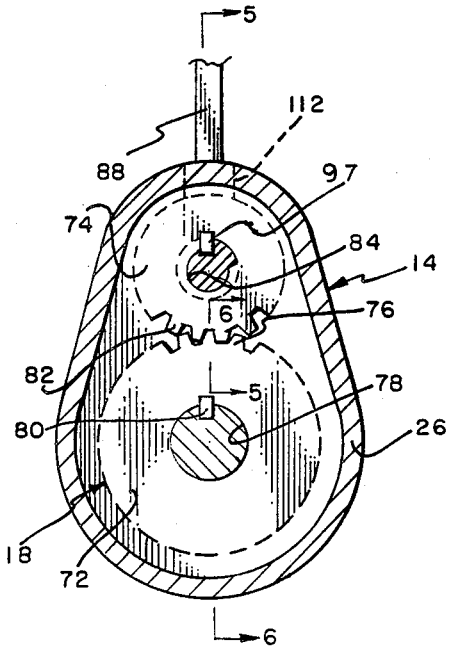
FIG. 4

FIG. 5
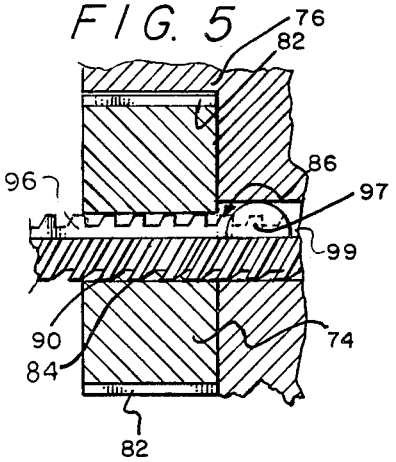
FIG. 6
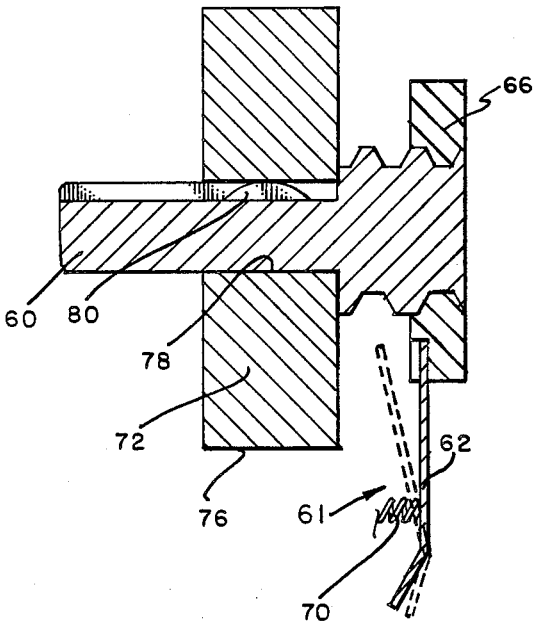
FIG. 7
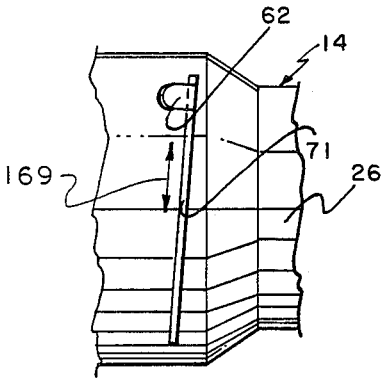
FIG. 8
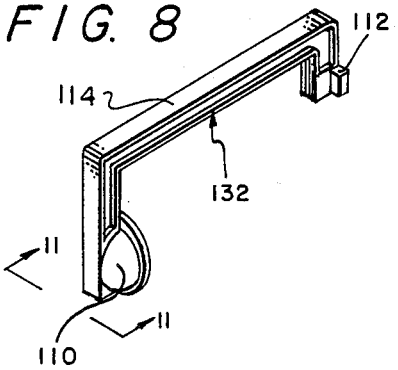
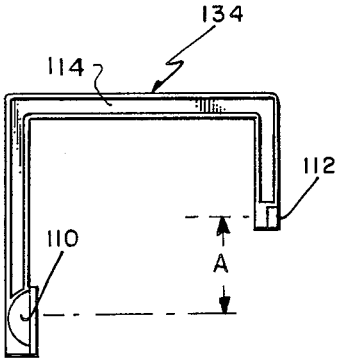
FIG. 9
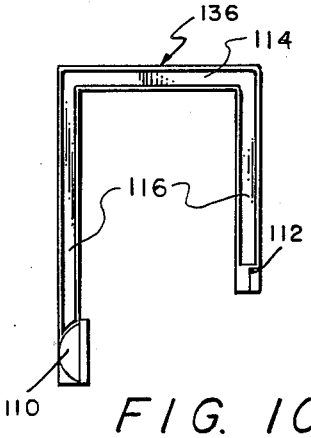
FIG. 10
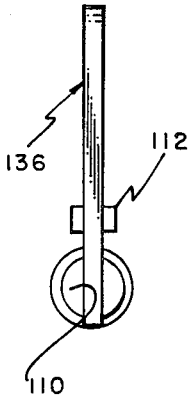
FIG. 11

POWERED C-CLAMP APPARATUS

PRIOR ART

A patent search revealed the following United States patents:

| Reg. No. | Patent | Inventor |
|---|---|---|
| 3,063,708 | ELECTRO MECHANICAL CLAMPING DRIVE WITH ELECTRIC CONTROL | Wollenhaupt |
| 3,704,879 | ELECTRIC VISE | Nishikawa |

The search was directed to a vise or C-clamp structure having an electrically powered drive motor member operable through a gear structure to axially move one portion of a clamp structure relative to a stationary clamp member. The moveable clamp portion includes a threaded shaft member mounted within a gear member which, in turn, is rotated by the drive motor member. An adjustable clutch is operable to achieve an adjustable clamping force on an object held between the movable and stationary clamp portions.

The Wollenhaupt Patent discloses an electromechanical clamping device having various electrical and spring loaded hydraulic controls to actuate the clamping pressure.

The Nishikawa patent discloses an electric vise structure using limit switches to milim amount of travel of a movable vise. A control switch 24 is operable to reverse direction of use movement through a reversible drive motor.

PREFERRED EMBODIMENT OF THE INVENTION

In one preferred embodiment of this invention, a powered C-clamp apparatus is provided which includes (1) a main housing assembly; (2) a power drive assembly mounted within the main housing assembly; (3) a gear drive assembly operably connected to the power drive assembly; (4) a C-clamp assembly connected to the gear drive assembly; and (5) a power control assembly operable to selectively control actuation of the power drive assembly, gear drive assembly, and the C-clamp assembly. The main housing assembly includes an enclosure housing having a battery pack housing connected thereto which can be in a rechargeable type unit. The power drive assembly includes a main motor assembly operable to rotate a drive shaft member through an adjustable clutch assembly to control the clamping force. The gear drive assembly includes a drive gear member powered by the drive shaft member through the adjustable clutch assembly to drive a driven gear member. The driven gear member is operably connected to the C-clamp assembly which includes a movable clamp member relative to an interchangeable stationary clamp member. The power control assembly includes a circuit assembly having a control switch and 2 limit switchs therein. The power control assembly operates to move the movable clamp member relative to the stationary clamp member and includes (1) means for automatically stopping axial movement of the movable clamp member, and (2) regulating the amount of clamping force to be achieved through the adjustable clutch assembly.

OBJECTS OF THE INVENTION

One object of this invention is to provide a powered C-clamp structure which is easily carried in a person's hand and readily portable to any job site location not requiring an external power source as utilizing a battery pack means.

Another object of this invention is to provide a powered C-clamp apparatus having a power driven, movable clamp member controlled through an adjustable clutch assembly to regulate the amount of clamping force as required so as to be usable for clamping purposes on rigid and delicate type objects.

Another object of this invention is to provide a powered C-clamp apparatus having a movable clamp member and a plurality of interchangable stationary clamp members being operable in numerous situations depending on the size and shape of the object to be clamped due to the new and novel designs of the interchangable clamp members.

Still, another object of this invention is to provide a powered C-clamp apparatus having a battery powered drive assembly operable through an adjustable clutch member and a gear drive assembly to selectively drive a movable clamp member wherein the adjustable clutch assembly is easily used to control the amount of clamping force between the movable clamp member and a stationary clamp member in order to firmly hold while protecting the items being clamped against damage.

Still, one further object of this invention is to provide a powered C-clamp apparatus which is compact in nature; easy to convey; relatively inexpensive to manufacture; sturdy in construction; and substantially maintenance free.

Various other objects, advantages, and features of this invention will become apparent to those skilled in the art from the following discussion, taken in conjunction with the accompanying drawings, in which:

FIGURES OF THE INVENTION

FIG. 1 is a perspective view of the powered C-clamp apparatus of this invention;

FIG. 2 is a side elevational view of the powered C-clamp apparatus of this invention having a sectional view of a main housing assembly for clarity;

FIG. 3 is a fragmentary sectional view taken along line 3—3 in FIG. 2;

FIG. 4 is a fragmentary sectional view taken along line 4—4 in FIG. 2;

FIG. 5 is an enlarged fragmentary sectional view taken along line 5—5 in FIG. 4;

FIG. 6 is an enlarged fragmentary sectional view taken along line 6—6 in FIG. 4;

FIG. 7 is a fragmentary bottom elevational view illustrating a portion of an adjustable clutch assembly of the powered C-clamp apparatus of this invention;

FIG. 8 is a perspective view of another embodiment of an interchangable stationary clamp member of this invention;

FIGS. 9, and 10 are side elevational views of further embodiments of the interchangable stationary clamp members of this invention; and FIG. 11 is an end view of the interchangable stationary clamp member as shown in FIG. 10.

FIG. 12 is a view of the circuit assembly of the powered C-clamp apparatus.

The following is a discussion and description of preferred specific embodiments of the powered C-clamp apparatus of this invention, such being made with reference to the drawings, whereupon the same reference numerals are used to indicate the same or similar parts and/or structrure. It is to be understood that such discussion and description is not to unduly limit the scope of the invention.

DESCRIPTION OF THE INVENTION

On referring to the drawings in detail and in particular to FIG. 1, a powered C-clamp apparatus of this invention, indicated generally at 12, includes (1) a main housing assembly 14; (2) a power drive assembly 16 mounted within the main housing assembly 14; (3) a gear drive assembly 18 mounted within the main housing assembly 14 and driven by the power drive assembly 16; (4) a C-clamp assembly 20 mounted on the main housing assembly 14 and driven by the gear drive assembly 18; and (5) a power control assembly 22 operably connected to the power drive assembly 16 to control operation thereof.

The main housing assembly 14 includes an enclosure housing 26 having a battery pack housing 28 connected thereto. The enclosure housing 26 includes a (1) a motor cavity 30; (2) a gear drive cavity 32; (3) a front wall 34; and (4) a top wall 36. The front wall 34 includes a clamp opening 38 to receive a portion of the C-clamp assembly 20 therethrough. The top wall 36 includes a switch opening 40 to receive a portion of the power control assembly 22 therethrough as will be noted.

The battery pack housing 28 consists of a pair of battery members 42 or a rechargable unit 44. The battery members 42 can be of a conventional type which can be replaced as deemed necessary. However, the power unit can be the rechargable unit 44 whereupon the entire rear battery pack housing 28 can be removed therefrom and plugged into an electrical 110 AC outlet for recharging. The use of a cadmium type rechargable power source is known in the prior art and may be used to energize the power drive assembly 16 of this invention.

The power drive assembly 16 includes a main motor assembly 46 operably connected to an adjustable clutch assembly 48. The main motor assembly 46 includes a shaft support member 50 adapted to support an armature member 52 therein which is connected to a drive shaft member 54. The shaft support member 50 includes a housing 57 having spaced bearing members 56 operable to support opposite ends of the drive shaft member 54.

The adjustable clutch assembly 48 includes (1) clutch plate assembly 57; (2) a bias assembly 58; (3) a driven shaft member 60; and (4) a clutch lever assembly 61. The clutch assembly 57 includes a first clutch member 64 engagable with an adjustable clutch member 66 to provide a variable driving force therebetween. Numerous types of variable speed clutch mechanisms are known in the prior art having variable drive through friction plates, centrifugal force, varying areas of contact or clutch structures.

The bias assembly 58 includes a compression spring member 68 operable to bias the adjustable clutch member 66 into contact with the first clutch member 64.

The driven shaft member 60 is connected to the adjustable clutch member 66 and rotatable therewith.

The clutch lever assembly 61 includes a clutch lever member 62 and a tension spring member 70 to bias the clutch lever member 62 out of engagement with the clutch member 66. The clutch lever member 62 is mounted within a clutch slot 71 for adjustable, rotatable movement of the adjustable clutch member 66 on the driven shaft member 60. The rotational movement of the adjustable clutch lever member 66 moves same axially on the drive shaft member 60 to increase or decrease pressure between the clutch members 64, 66. The clutch member 62 is selectively pivotal against the tension spring member 70 as noted in solid lines in FIG. 6. into engagement with the adjustable clutch member 62 to adjust pressure against the first clutch member 64.

The gear drive assembly 18 includes a drive gear member 72 connected to the driven shaft member 60 and operably engagable with a driven gear member 74. The driven gear member 74 is rotatably mounted between bearing members 75.

The drive gear member 72 has drive teeth members 76 on an outer periphery; a shaft opening 78 having the drive shaft member 60 mounted therethrough; and a key member 80 to interconnect the drive shaft member 60 to the drive gear member 72.

The driven gear member 74 includes outer peripherial driven teeth members 82 engagable with the drive teeth members 76 on the drive gear member 72 and having a threaded clamp shaft opening 84 in the center thereof.

The C-clamp assembly 20 includes a movable clamp member 86 axially movable by the driven gear member 74 and operably associated with interchangable clamp member 88.

As best shown in FIG. 2, the movable clamp member 86 includes a main clamp shaft 90 having a pivotal clamp head member 92 connected thereto. The main clamp shaft 90 has a helical external threaded section 94; a key way 96 to receive a key member 97 therein; spaced actuator projections 98; and a head connector 102 connected to the clamp head member 92. The key member 97 is mounted within a slot 99 in the enclosure housing 76 so as to be stationary as the main clamp shaft 90 moves axially relative thereto.

The clamp head member 92 is provided with a front clamp wall 104 extended in a common plane and a central connector cavity 106 which allows for pivotal movement of the entire clamp member 92 to conform to irregular surfaces found in a clamping operation.

The interchangable clamp member 88 includes (1) a main clamp body 108; (2) a clamp head member 110 connected to the main clamp body 108; and (3) a connector assembly 112 connected to the other end of the main clamp member 108.

The main clamp body 108 is of an I-beam construction in transverse cross section having a central section 114 with parallel end wall sections 116 at opposite ends thereof extended perpendicular to the central section 114.

The clamp head member 110 is provided with an outer clamp face section 118 adapted to clamp a object between this face section 118 and the front clamp wall 104 of the movable clamp member 86.

As noted in FIG. 3, the connector assembly 112 includes a head section 120; a spring connector assembly 122; and a connector ball member 124. The head section 120 is provided with a grooved portion 126 adapted to fit within a similar receiving groove portion 126 within the top portion of the enclosure housing 26.

The spring connector assembly 122 includes a spring connector cavity 128 having a spring member 130 therein to bias the connector ball member 24 into a semi-circular cavity 125 within the groove portion 126 in the enclosure housing 26. This is a detente type connector which is known in the art as shown in FIG. 3 so that the interchangable clamp member 88 can be moved upwardly as shown by arrow 135 in FIG. 2 so as to be interchanged as so desired.

As noted in FIGS. 8–11, inclusive, it is seen that a plurality of other embodiments of interchangable clamp members 132, 134, and 136 are provided. The interchangable clamp member 132 in FIG. 8 is shown as having a limited height but extended length thereof and having the previously described clamp head member 110 and the connector assembly 112 connected to opposite ends of the control section 114. This then permits the interchangable clamp member 132 to easily replace the interchangable clamp member 88 as so deemed necessary.

Another embodiment is the interchangable clamp member 134 in FIG. 9 showing again a different shape having the clamp head member 110 extended downwardly a considerable distance and the connector assembly 112 connected to opposite ends of a control section 114 which can replace the interchangable clamp members 88 or 132 if so desired. It is noted that this structure is designed to be usable in a clamping function about various shaped items and it is noted that the vertical distance between the clamp head member 110 and the connector assembly 112 of all embodiments as indicated by letter "A" is of a constant distance so as to assure when connected that the respective slamp head members 110 will be engagable with the movable clamp member 86.

The other embodiment of the interchangable clamp member 136 is shown in FIGS. 10 and 11 having a substantial height of end wall sections 116 allowing large objects to be clamped therebetween which is not possible with the interchangable clamp member 132 or 88.

It is obvious that various other embodiments of the interchangable clamp members can be provided so that the power C-clamp apparatus 12 of this invention would be operable to clamp objects of various shapes, lengths, and widths as so required.

As noted in FIG. 10, the power control assembly 22 includes a circuit assembly 140; a control switch 142 mounted in the circuit assembly 140; and a limit switch 144 also mounted in the circuit assembly 140. The circuit assembly 140 is connected to the battery members 42 or the rechargable unit 44 so as to derive an electrical source such as 12 volt direct current. The circuit assembly 140 includes a power line indicated as "L-1" being 143 and the other power line indicated at "L-2" being indicated at 145 being connected to the power supply 42 or 44. The line 143 is connected to a movable switch 149 to either terminals 146 or 148 of the control switch 142.

The line "L-2" being 145 is connected to a terminal 150 at the main motor assembly 46 to provide one power line for selective energization as will be explained.

The terminal 146 is connected to a line 152 which is, in turn, connected to a terminal 156 in the limit switch 144.

The terminal 148 is connected through a line 154 to a terminal 158 which is a part of the limit switch 144. The limit switch 144 includes another terminal 160 which is connected by a line 164 to a terminal 170 at the main motor assembly 46. The terminal 158 is selectively connected through the limit switch 144 to a terminal 162 which is connected by a line 166 to a terminal 168 at the main motor assembly 46.

It is noted that power to the main motor assembly 46 is constantly supplied from "L-2" through line 145 and selectively supplied through lines 164 or 166 through the limit switch 144. The limit switch 144 is operable to provide the other circuit "L-1" to the main motor assembly 46 depending on the position of a movable switch lever 163 for the position of the control switch 142. The control switch 142 is operable to energize the main motor assembly 46 and rotate the movable clamp member 86 in opposite directions for clamping and unclamping operations as so desired.

The limit switch 144 is operable as a safety feature to cease movement of the movable clamp member 86 in both extremes of operation to prevent damage to the main motor assembly 46. The spaced actuator projections 98 on the main clamp shaft 90 contact the limit switch 144 to move the switch lever 163 up or down from the position of FIG. 3 to cause cessation of power flow through one of the control levers 165.

USE AND OPERATION OF THE INVENTION

In the use and operation of the powered C-clamp apparatus 12 of this invention, it is obvious that it is first necessary to have the battery pack housing 28 with the battery members 42 or rechargable unit 44 maintained in a peak, charged power condition in order to provide the necessary energy to drive the power drive assembly 16 and the interconnected gear drive assembly 18.

Next, a selected one of the interchangable clamp members 88, 132, 134, or 136 are readily mountable into a usage position with the rest of the powered C-clamp apparatus 12 as noted in FIGS. 1 and 2. Assuming the interchangable clamp member 88 is attached, the control switch 142 can be activated in order to retract the movable clamp member 86 into its fully retracted position whereupon the clamp head member 92 is placed adjacent the front wall 34 of the enclosure housing 26. During this movement, the actuator projection 98 in the center area of the main clamp shaft 90 engages the limit switch 144 to de-energize the main motor assembly 46. This moves the movable switch lever 163 to lift the control lever 165 from terminals 158 and 162 and contact terminals 156 and 160. The control switch 142 is now operable to be moved to energize the main motor assembly 46 to move the movable clamp member 86 into a usage position.

Next, an object can be placed between the open space between the clamp head member 110 of the interchangable clamp member 88 and the front clamp wall 104 of the movable clamp member 86. Then, depending on the nature of the object to be clamped whether of hardened steel or a delicate honeycomb type material that would be damaged by excessive pressure, it is seen that the adjustable clutch assembly 48 and, more particularly clutch lever 62, can be moved within the clutch slot 71 as noted by an arrow 169 in FIG. 7. Movement of the clutch lever 62 will adjust the clutching force between the first clutch member 64 and the adjustable clutch member 66. It is obvious that the biasing assembly 58 and, more particularly the compression spring member 68 is operable to vary the force of functional contact between the first clutch member 64 and the adjustable clutch member 66. The main motor assembly 46 would continue to rotate the drive shaft member 54 and interconnected first clutch member 64 which would slip relative to the adjustable clutch member 66 so that further axial movement of the movable clamp member 86 would not occur. There would a direct relationship between the clamping force being obtained and the spring biasing adjustment set on the adjustable clutch assembly 48.

At this moment, the operator of the powered C-clamp apparatus 12 would turn off the control switch 142 whereupon the object would be then be clamped at the desired pressure between the moveable clamp member 86 and the interchangable clamp member 88.

Thus, on completing an activity on the object being clamped such as a machining operation or a gluing together of two pieces of wood or the like, it is noted that the control switch 142 can be energized to interconnect the lines 152 and 164 through the upper control lever 165 to cause the movable clamp member 86 to be moved toward the retracted position. The movable clamp member 86 is then moved within the enclosure housing 26 to the retracted position and the inner end or portion of the drive shaft member 54 would engage the limit switch 144 with the central actuator projection 98 and cease energization of the main motor assembly 46.

Therefore, it is seen that the powered C-clamp apparatus 12 of this invention is now in the retracted position ready to proceed with another clamping operation as previously described.

It is seen that the powered C-clamp apparatus of this invention provides a new and novel compact structure which is readily transportable to any place where a C-clamp is necessary and having its own portable power source which can be readily recharged.

It is noted that the interchangable clamp members can be easily mounted and removed from the main housing assembly as so desired and having numerous heights, widths, and shapes so as to be usable on objects of various heights, widths, and configurations which is not achievable by the normal mechanical C-clamp structures.

The power control assembly of this invention provides a new and novel circuit assembly for reversible motor operation and travel limit control features. The adjustable clutch assembly of this invention presents a means for regulating the desired pressure of clamping an object between the movable clamp member and the stationary interchangable clamp member. This is a desirable feature when utilizing the power C-clamp apparatus on identical objects in a continuous clamping operation so that, once the proper pressure force is set, this will be consistant and repeat due to the set adjustment of the adjustable clutch assembly.

It is seen that the powered C-clamp apparatus of this invention is compact in nature; adjustable in clamping force; readily portable and transported; provided with its own independent power source; sturdy in construction; and easy and safe in usage.

While the invention has been described in conjunction with preferred specific embodiments thereof, it is to be understood that this description is intended to illustrate and not to limit the scope of the invention, which is defined by the following claims.

I claim:

1. A powered C-clamp apparatus adapted to clamp objects of various sizes therein and regulate the clamping force applied thereto, comprising:

(a) a main housing assembly;

(b) a power drive assembly mounted within said main housing assembly and having a main motor assembly operable to drive an output drive shaft member;

(c) a gear drive assembly connected to said drive shaft member;

(d) a C-clamp assembly having a movable clamp member engagable with said drive gear assembly to move said movable clamp member axially to clamp the object between same and an interchangable clamp member; and (e) said C-clamp assembly includes said interchangable clamp member which is releasably connected to said main housing assembly and said interchangable clamp member being of various sizes and shapes and cooperating with said movable clamp member to clamp an object therebetween, said power drive assembly comprising an adjustable clutch assembly between said drive shaft member of said main motor assembly and a driven shaft member and being operable to provide adjustable clamping force between said movable clamp member and said interchangable clamp member.

2. A powered C-clamp apparatus as described in claim 1, wherein:

(a) said adjustable clutch assembly having a first clutch member engagable with an adjustable clutch member and having a bias assembly operable through a clutch lever member to adjust the pressure between said first clutch member and said adjustable clutch member to achieve variation of clamping force between said movable clamp member and said interchangable clamp member.

3. A powered C-clamp apparatus as described in claim 1, wherein:

(a) said movable clamp member movable axially without rotation thereof providing a safety feature to prevent injury to the operator thereof or damage to the object being clamped.

4. A powered C-clamp apparatus as described in claim 1, including:

(a) a power control assembly having a circuit assembly with a control switch and a limit switch therein; and (b) said control switch movable from an off to selective on positions to control direction of movement of said movable clamp member due to the reversible nature of said main motor assembly.

5. A powered C-clamp apparatus as described in claim 4, wherein:

(a) said limit switch having means operably connected to said movable clamp member so as to provide an automatic feature for ceasing energization said main motor assembly on outer limits of travel of said movable clamp member.

6. A powered C-clamp apparatus adapted to clamp an object therebetween under predetermined preselected pressure, comprising:

(a) a main housing assembly;

(b) a power drive assembly mounted within said main housing assembly having a main motor assembly operable to rotate a drive shaft member;

(c) a gear drive assembly engagable with said drive shaft member;

(d) said gear drive assembly including a drive gear member connected with said drive shaft member and engagable with a driven gear member;

(e) a C-clamp assembly having a movable clamp member and a stationary clamp member;

(f) said movable clamp member having a main clamp shaft engagable with a portion of said driven gear member so that on rotation of said driven gear member, said main clamp shaft moves axially without rotation thereof to form a clamping action on an object between said movable clamp member and said stationary clamp member, said power drive assembly comprising an adjustable clutch assembly between said drive shaft member of said main motor assembly and said drive gear member and being operable to provide adjustable clamping force between said movable clamp member and said stationary clamp member.

7. A powered C-clamp apparatus as described in claim 6, wherein:

(a) said stationary clamp member being of various heights and widths thereof so as to be readily interchanged and attached to said main housing assembly to provide numerous variations in in clamping functions with a single one of said power C-clamp apparatus of this invention.

8. A power C-clamp apparatus as described in claim 7, wherein:

(a) said stationary clamp member having a connector assembly mounted within an opening in said main housing assembly;

(b) said connector assembly having a head section with a grooved portion; and (c) said opening in said main housing having a receiving groove to receive said grooved portion therein to prevent relative rotational movement of said stationary clamp member.

9. A powered C-clamp apparatus as described in claim 6, including:

(a) a powered control assembly having a control circuit with a control switch and a limit switch mounted therein;

(b) said control switch operably connected to said main motor assembly and operable in off position to cease movement of said main motor assembly;

(c) said control switch operable in a second position to cause rotation of said main motor assembly and an interconnected said drive shaft member in one direction to achieve a clamping action; and (d) said control switch movable to a third position so as to energize said main motor assembly so as to rotate said drive shaft member in a direction opposite to said one direction to a retracted position.

10. A powered C-clamp apparatus as described in claim 9, wherein:

(a) said limit switch operably connected in said circuit assembly to said main motor assembly and operable in one position to cease power to said main motor assembly when in the fully retracted position and operable in a second position to cease energization of said main motor assembly when in the fully extended position to assure that said movable clamp member will not be damaged by movement beyond the extremes of the extended and retracted positions.

11. A powered C-clamp apparatus as described in claim 9, wherein:

(a) said main clamp shaft movable axially, but not rotatable in said main housing assembly; and (b) said main clamp shaft having lateral projections engagable with said limit switch to control energization of said main motor assembly.

12. A power C-clamp apparatus as described in claim 11, wherein:

(a) said power drive assembly includes an adjustable clutch assembly connected to said drive shaft member and said gear drive assembly to regulate clamping force between said movable clamp member and said stationary clamp member.

13. A power C-clamp apparatus as described in claim 6, wherein:

(a) said stationary clamp member constructed of irregular sizes and shapes so as to be usable on objects of irregular sizes and shapes.

* * * * *